US007870987B1

(12) United States Patent
Zhang et al.

(10) Patent No.: US 7,870,987 B1
(45) Date of Patent: Jan. 18, 2011

(54) FASTENER DRIVING TOOL WITH PROTECTION INSERTS

(75) Inventors: Yizhuo Zhang, Arlington Heights, IL (US); Marco Laubach, Wheeling, IL (US)

(73) Assignee: Robert Bosch GmbH, Stuttgart (DE)

( * ) Notice: Subject to any disclaimer, the term of this patent is extended or adjusted under 35 U.S.C. 154(b) by 65 days.

(21) Appl. No.: 12/494,633

(22) Filed: Jun. 30, 2009

(51) Int. Cl.

| | |
|---|---|
| ***B21J 15/28*** | (2006.01) |
| ***B27F 7/17*** | (2006.01) |
| ***B31B 1/70*** | (2006.01) |
| ***B25C 7/00*** | (2006.01) |

(52) U.S. Cl. ..... 227/8; 227/107; 227/140

(58) Field of Classification Search ..... 227/8, 227/107, 140

See application file for complete search history.

(56) References Cited

U.S. PATENT DOCUMENTS

| | | | | |
|---|---|---|---|---|
| 4,452,387 | A * | 6/1984 | Haytayan | 227/8 |
| 5,649,661 | A * | 7/1997 | Masuno et al. | 227/8 |
| 5,862,970 | A | 1/1999 | Cougar | |
| 7,055,728 | B2 | 6/2006 | Lin | |
| 7,070,079 | B2 * | 7/2006 | Smolinski et al. | 227/8 |
| 7,210,607 | B2 | 5/2007 | Niblett et al. | |
| 2004/0011848 | A1 * | 1/2004 | Farassat | 228/1.1 |
| 2009/0084823 | A1 * | 4/2009 | Tanji et al. | 227/8 |
| 2010/0155097 | A1 * | 6/2010 | Krondorfer et al. | 173/210 |
| 2010/0213234 | A1 * | 8/2010 | Ronn et al. | 227/130 |

* cited by examiner

*Primary Examiner*—Rinaldi Rada
*Assistant Examiner*—Robert F Long
(74) *Attorney, Agent, or Firm*—Maginot, Moore & Beck

(57) ABSTRACT

A fastener driving tool includes a housing, a nose assembly having a fastener passage configured to allow fasteners to be advanced therethrough, and a safety contact assembly movable in relation to the nose assembly between a disable position and an enable position. A magazine assembly is configured to supply fasteners toward the nose assembly, and a driver is configured to cause a fastener located in the fastener passage to be advanced within the nose assembly. The nose assembly includes (i) a base member defining at least a portion of the fastener passage and has a first recess and a second recess which are spaced apart from each other, (ii) a first protection insert located in the first recess, and (iii) a second protection insert located in the second recess. The base member defines a leading side surface and a trailing side surface. The leading side surface defines an ejection orifice that is aligned with the fastener passage. The leading side surface defines a first opening aligned with the first recess and a second opening aligned with the second recess, and the trailing side surface defines a third opening aligned with the first recess and a fourth opening aligned with the second recess. The first protection insert extends through the first opening and the third opening, and the second protection insert extends through the second opening and the fourth opening.

20 Claims, 8 Drawing Sheets

FASTENER DRIVING TOOL WITH PROTECTION INSERTS

FIELD OF THE INVENTION

This invention relates to the field of devices used to drive fasteners into work-pieces and particularly to a work contact element for use with such devices.

BACKGROUND

Fasteners such as nails and staples are commonly used in projects ranging from crafts to building construction. While manually driving such fasteners into a work piece is effective, a user may quickly become fatigued when involved in projects requiring a large number of fasteners and/or large fasteners to be driven into a work piece. Moreover, proper driving of larger fasteners into a work piece frequently requires more than a single impact from a manual tool.

In response to the shortcomings of manual driving tools, power-assisted devices for driving fasteners into work pieces have been developed. Contractors and homeowners commonly use such devices for driving fasteners ranging from brad nails used in small projects to common nails which are used in framing and other construction projects. Compressed air has been traditionally used to provide power for the power-assisted (pneumatic) devices.

Various safety features have been incorporated into pneumatic and other power nailers. One such device is commonly referred to as a work contact element (WCE). A WCE is incorporated into nailer designs to prevent unintentional firing of the nailer. A WCE is typically a spring loaded mechanism which extends forwardly of the portion of the nailer from which a nail is driven. In operation, the leading side surface, or contact surface of the WCE is pressed against a work piece into which a nail is to be driven. As the WCE is pressed against the work piece, the WCE compresses the spring and generates an axial movement which is transmitted to a trigger assembly. The axial movement is used to reconfigure a safety device, also referred to as a trigger enabling/disabling mechanism, so as to enable initiation of a firing sequence with the trigger of the nailer.

Nailers may be used for many different jobs. One particular type of job where nailers have found widespread use is in the installation of roofing materials, such as asphalt shingles. Asphalt shingles are a very abrasive material due to the granules of stone that are on the surface of the shingles. Repeated contact between the contact surface of the work contact element and the shingles may cause wear to the contact surface. Due to the potential for wear during roofing applications, some previously known nailers have incorporated wear resistant inserts into the contact surface of the work contact element. The previously known inserts were typically round inserts positioned on opposing sides of the ejection orifice in the work contact element and protruding from the contact surface to contact the abrasive surface of the shingles so as to limit contact between the contact surface and the shingles.

Other surfaces of the WCE may also be susceptible to wear during the installation of shingles. For example, the fastener driving tool may be provided with a shingle gauge assembly to aid in the uniform spacing of shingles. The shingle gauge includes an alignment surface that is substantially parallel to an upper trailing side of the WCE that may be used to control the distance that a fastener is placed into a shingle from the edge of the shingle. During use, the alignment edge of the shingle gauge is lined up with a previously installed shingle. The upper trailing side surface of the WCE may then be used to line up the next row of shingles. This action causes the trailing side surface of the WCE to be pressed and rubbed against the narrow edge of shingles which may result in wear on the trailing side front surface of the work contact element.

One method that may be used to prevent or limit wear to the trailing side surface of the WCE is to add additional inserts that protrude from the trailing side surface to contact the narrow edge of shingles during the alignment process discussed above with regard to the shingle gauge. However, adding additional inserts to the WCE may increase the complexity and cost of manufacturing of the work contact element and have a negative impact on the structural integrity of the WCE.

SUMMARY

In accordance with one embodiment, there is provided a fastener driving tool that includes a housing, a nose assembly having a fastener passage configured to allow fasteners to be advanced therethrough, and a safety contact assembly movable in relation to the nose assembly between a disable position and an enable position. A magazine assembly is configured to supply fasteners toward the nose assembly, and a driver is configured to cause a fastener located in the fastener passage to be advanced within the nose assembly. The nose assembly includes (i) a base member defining at least a portion of the fastener passage and has a first recess and a second recess which are spaced apart from each other, (ii) a first protection insert located in the first recess, and (iii) a second protection insert located in the second recess. The base member defines a leading side surface and a trailing side surface. The leading side surface defines an ejection orifice that is aligned with the fastener passage. The leading side surface defines a first opening aligned with the first recess and a second opening aligned with the second recess, and the trailing side surface defines a third opening aligned with the first recess and a fourth opening aligned with the second recess. The first protection insert extends through the first opening and the third opening, and the second protection insert extends through the second opening and the fourth opening.

DESCRIPTION

Figure 1:
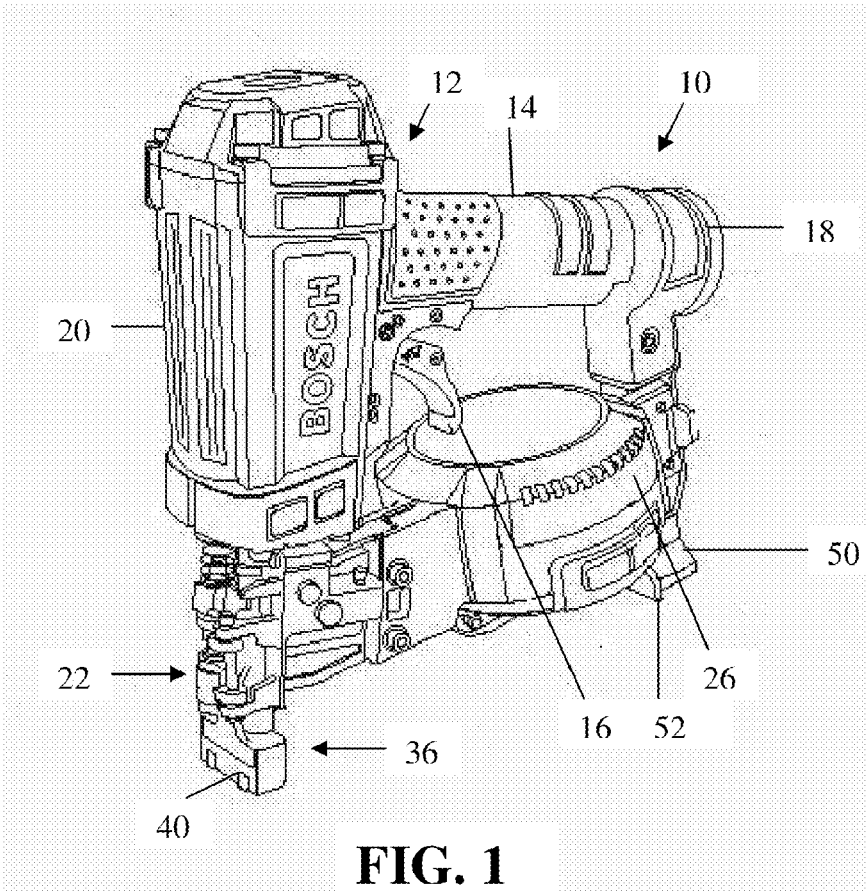
FIG. 1 depicts a side perspective view of a fastener driving tool in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
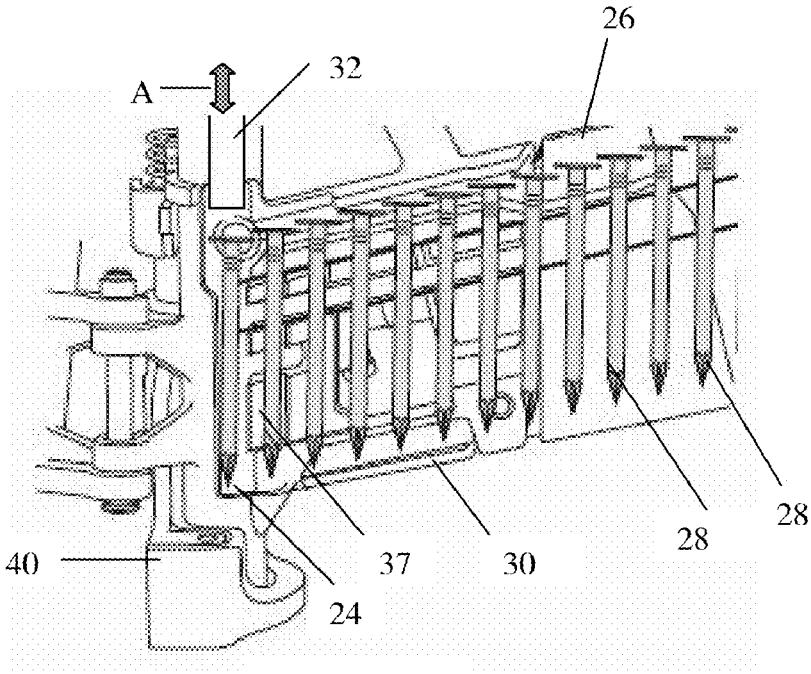
FIG. 2 depicts a partial side cut away view of the drive section, nose assembly, and magazine assembly of the fastener driving tool of FIG. 1.

FIG. 1 depicts a fastener driving tool 10 including a housing 12 that defines a handle portion 14 from which a trigger 16 extends, a receptacle area 18 and a drive section 20. Located adjacent to the drive section 20 is a nose assembly 22 that defines a longitudinally extending fastener passage 24 (best seen in the cross-sectional view of FIG. 2). A magazine assembly 26 is constructed and arranged to sequentially feed fasteners 28, such as nails or staples, from a supply of fasteners contained therein along a supply path 30 and into the fastener passage 24 (FIG. 2). Although the illustrated magazine assembly 26 is configured to receive fasteners that are collated in a coil configuration, it is also contemplated that a magazine assembly that is configured to accommodate fasteners that are collated in a stick configuration may also be used. The drive section 20 encloses a driving mechanism that is constructed and arranged to drive a fastener through the fastener passage outwardly into a workpiece in response to actuation of the driver mechanism by trigger 16.

FIG. 2 shows a partial cut away view of the nose assembly 22, drive section 20, and magazine assembly 26 of the fastener driving tool 10 of FIG. 1. As depicted, the driving mechanism includes a fastener driver 32, also referred to as a driver blade, that is configured to enter the fastener passage 24 and successively drive the fasteners 28, one at a time, out of the fastener passage 24 in a known manner. The fastener magazine assembly 26 is operable to sequentially feed fasteners 28 along a supply passage 30 and through a lateral opening 37 into the fastener passage 24. A fastener feeding mechanism (not shown) may be provided as part of the fastener magazine assembly 26. The fastener feeding mechanism is biased in a conventional manner, such as by a spring, to move fasteners along the supply passage toward the fastener passage.

The fastener driver 32 is configured to be moved into and out of the fastener passage 24 along an axis A that is aligned with the fastener passage 24. Any suitable device or method may be used to cause the fastener driver 32 to drive fasteners into and out of the fastener passage. In one embodiment, the fastener driving tool 10 is configured to use a pneumatic driving force to actuate the fastener driver. In this embodiment, the handle portion 14 of the housing may include a reservoir (not shown) therein for pressurized air supplied by a conventional pressurized air source (not shown). The receptacle area 18 may be used to connect a source of compressed air or other source of power to the reservoir in the handle portion of the fastener driving tool. The drive section 20 of the housing may include a cylinder (not shown) with a reciprocating piston (not shown) operably coupled to the driver blade such that when the trigger is actuated, air forces the piston downward, causing driver blade 32 to force a fastener 28 located in the fastener passage 24 out the end of the fastener passage.

The fastener driving mechanism described herein is exemplary only and is not intended to be limiting. It is understood that a fastener driving mechanism of any conventional construction may be used and is not limited to the representative embodiment disclosed in the present application. For example, in alternative embodiments, the fastener driving mechanism of the fastener driver may be actuated by a fly wheel assembly or a solenoid assembly in electrically actuated tools. The driver may also be actuated by internal combustion.

Figure 3:
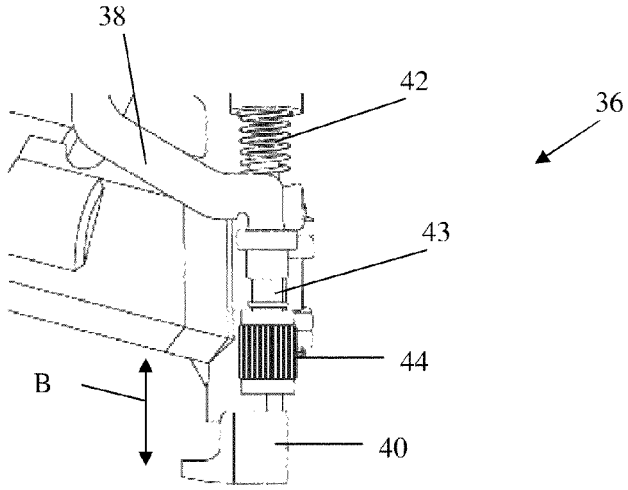
FIG. 3 depicts a side view of the contact safety assembly of the fastener driving tool of FIG. 1.
Figure 4:
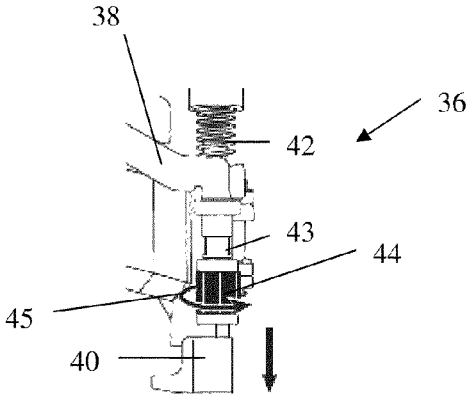
FIG. 4 depicts another side view of the contact safety assembly of the fastener driving tool of FIG. 1.

The fastener driving tool 10 includes a contact safety assembly 36 configured to prevent actuation of the driver mechanism when the nose assembly 22 is not in contact with a workpiece (not shown). As best seen in FIG. 3, the contact safety assembly 36 includes a trigger enabling portion 38 and a work contact element 40. The work contact element 40 is coupled to the nose assembly 22 for longitudinal movement along axis B with respect to the nose assembly 22 between an extended position, also referred to as the disable position, and a retracted position, also referred to as the enable position. The work contact element 40 may be biased toward and into its extended position by a conventional coil spring 42 that is mounted between the work contact element 40 and the housing 12. When the work contact element 40 is placed in contact with a workpiece, the work contact element 40 is moved from the extended position to the retracted position.

The work contact element 40 is operably coupled to the trigger enabling portion 38 such that movement of the work contact element 40 between the retracted and extended positions mechanically repositions the trigger enabling portion 38. When the work contact element 40 is moved to the retracted position, the trigger enabling portion 38 is configured to place the trigger 16 in an active state or condition so that manual movement of the trigger 16 thereafter through its actuation stroke is capable of actuating the fastener driving mechanism. When the work contact element 40 is in the extended position, the trigger enabling portion 38 places the trigger 16 in an inactive state or condition to prevent the fastener driving tool 10 from being accidentally actuated if the trigger mechanism 16 is moved through its actuation stroke. The trigger enabling portion 38 of the contact safety assembly 36 may be implemented in any suitable manner.

Figure 5:
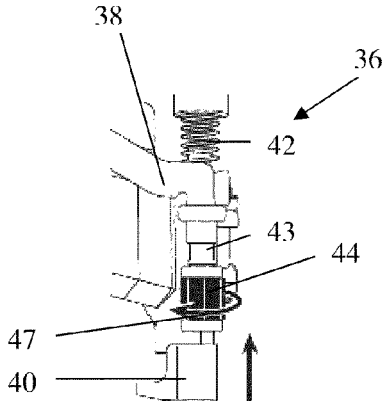
FIG. 5 depicts another side view of the contact safety assembly of the fastener driving tool of FIG. 1.
Figure 6:
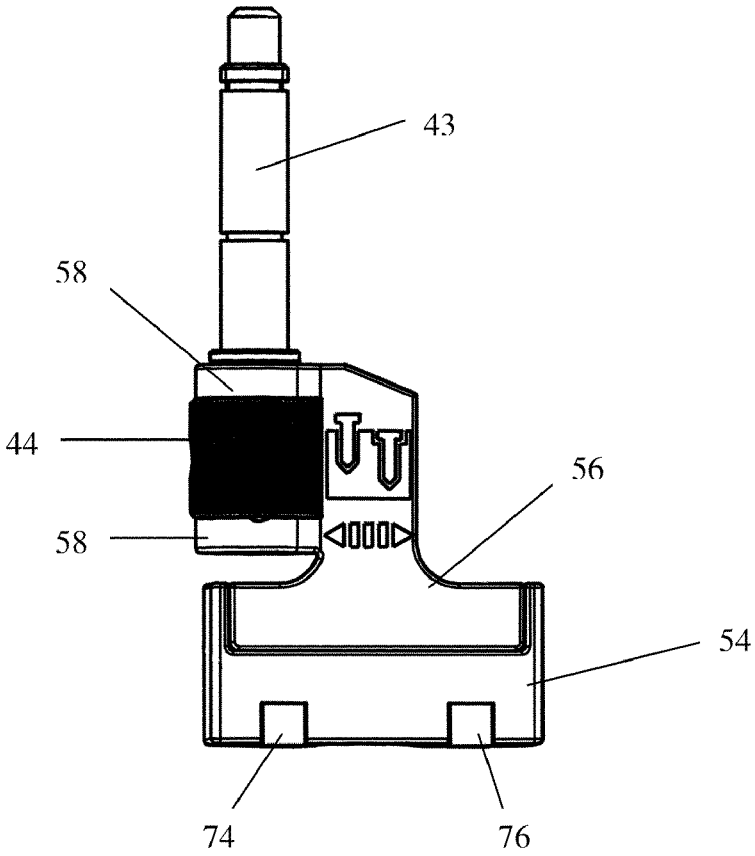
FIG. 6 depicts a front view of the work contact element of the contact safety assembly of FIG. 3.

Referring now to FIGS. 3-6, the depth to which the fastener is driven into the work piece may be controlled by a depth adjustment assembly operably positioned between the work contact element 40 and the trigger enabling portion 38. The depth adjustment assembly in this embodiment includes a threaded intermediate linkage rod 43 upon which a threaded adjuster wheel 44 is located. In the exemplary embodiment, the upper portion of the linkage rod 43 is threaded into a threaded lower portion of the trigger enabling portion 38 (best seen in FIGS. 3-5), and the rod 43 is attached to the adjuster wheel by a roll pin. Turning the adjuster wheel 44 transmits rotation to the linkage rod 43 and advances the upper threaded portion of the rod 43 into threaded portion of 38. This changes the effective length of entire WCE assembly and the depth at which fasteners are driven. For example, rotation of the threaded adjuster wheel 44 in a first direction 45 decreases the depth to which a fastener may be driven into a workpiece (FIG. 4), and rotation of the threaded adjuster wheel 44 in a second direction 47 increases the depth to which a fastener may be driven into a workpiece (FIG. 5).

Figure 14:
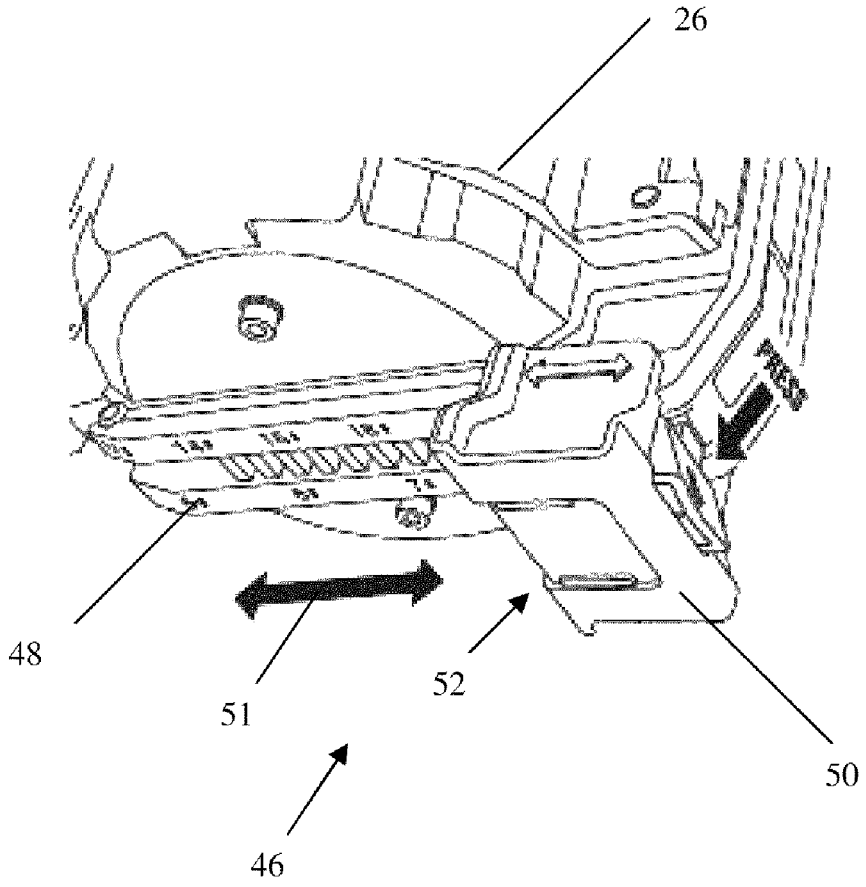
FIG. 14 depicts a partial bottom perspective view of the fastener driving tool of FIG. 1 showing the shingle gauge.

The exemplary fastener driving tool 10 depicted in FIG. 1 is adapted for use in roofing applications, and, in particular, to fastening shingles to a roof. In the exemplary embodiment, the fastener driving tool 10 is provided with a shingle gauge assembly 46 to facilitate uniform spacing between rows of shingles. Referring to FIG. 14, the shingle gauge assembly 46 includes a mounting bracket 48 which is affixed to the bottom of the fastener magazine assembly 26. A shingle gauge 50 is supported in the bracket 48 for movement along an axis 51 toward and away from the work contact element 40 on the nose assembly 22 of the driving tool. The shingle gauge 50 includes an alignment surface 52 that is substantially parallel to the upper trailing side surface of the work contact element 40 (best seen in FIG. 1) that may be used to control the exposed distance of the first shingle. The shingle gauge 50 is adjustable to accommodate various fastener placement positions as well as different sizes of shingles. During use, the alignment edge 52 of the shingle gauge is lined up with a previously installed shingle. As is known in the art, the upper trailing side surface of the work contact element 40 may then be used to line up the next shingle.

Figure 7:
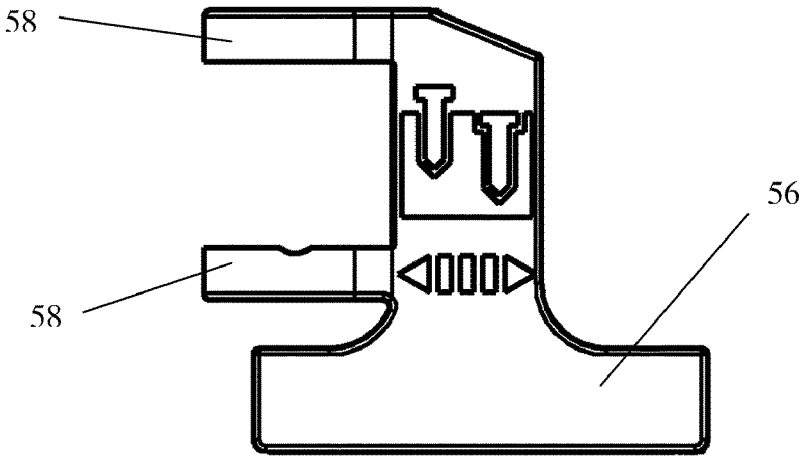
FIG. 7 depicts a front view of the support member of the work contact element of FIG. 6.
Figure 8:
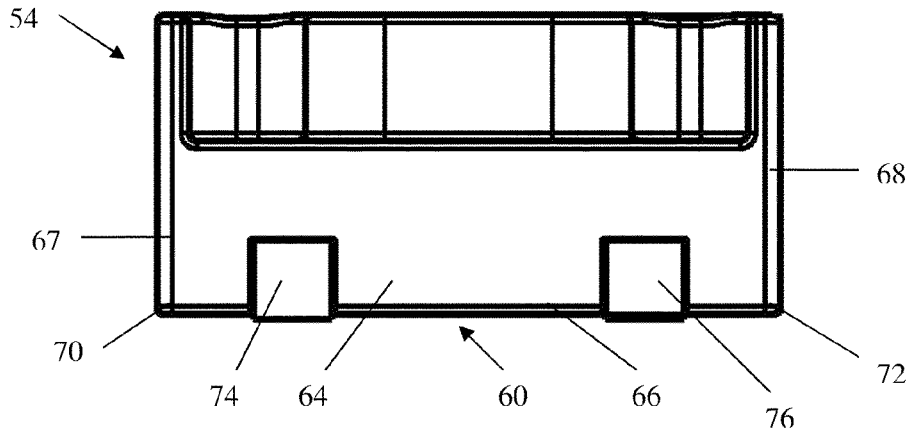
FIG. 8 depicts a front view of the base member of the work contact element of FIG. 6.
Figure 9:
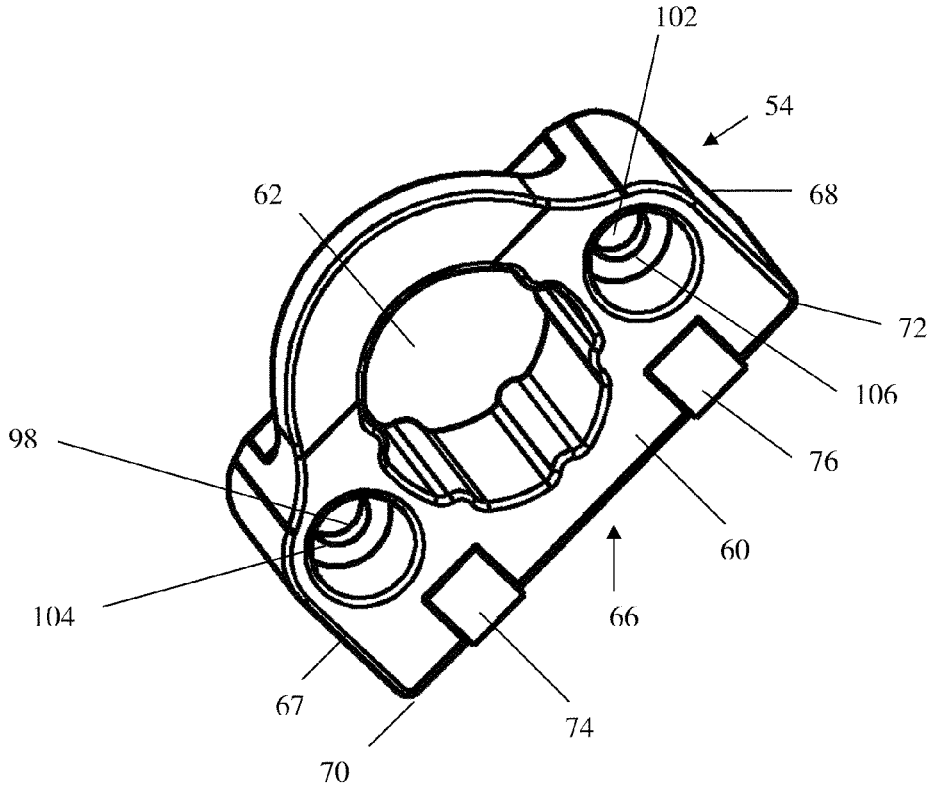
FIG. 9 is perspective view of the work contact element of FIG. 8.

Referring now to FIG. 7, the work contact element 40 includes a base member 54 that is removably attached to a support member 56 (explained in more detail below). In one embodiment, the support member 56 and the base member 54 are each formed of steel although any suitable rigid, sturdy material may be used. The base member 54 is supported at a distal end of the fastener passage 24 in the nose assembly 22 by the support member. The support member 56 is also operably coupled to the threaded intermediate linkage rod 42 and threaded adjuster wheel 44. In one embodiment, the support member 56 includes a pair of support rings 58 through which the intermediate linkage rod 42 is configured to extend as depicted in FIG. 8. The threaded adjuster wheel 44 is located on the linkage rod 43 between the support rings 58 (FIG. 7) so that rotation of the wheel 44 adjusts the depth to which a fastener may be driven into a workpiece (as explained above in relation to FIGS. 3-6).

With reference to FIGS. 9-12, the base member 54 includes a contact surface 60, also referred to as a leading side surface. The leading side surface 60 is a substantially flat surface positioned to face and come into contact with the workpiece into which a fastener is to be driven and is oriented so that it is substantially perpendicular to the longitudinal axis A of the fastener passage 24. The leading side surface 60 of the base member 54 includes an ejection opening 62, or orifice, that extends through the base member 54 that is positioned for alignment with the fastener passage 24 and thus defines a portion of the fastener passage 24 for the fastener driving tool. In one embodiment, the ejection orifice 62 is sized to receive the distal end of fastener passage 24 of the nose assembly so that when the work contact element is pressed against a workpiece, the distal end of the fastener passage moves into the ejection opening and into contact with the workpiece.

Figure 12:
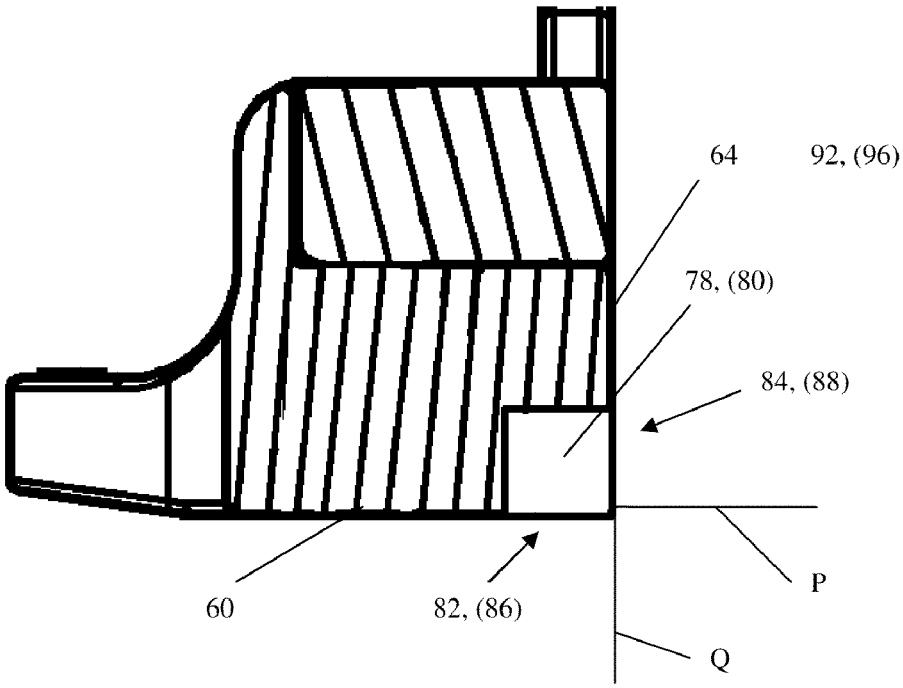
FIG. 12 depicts a side cross-sectional view of the work contact element of FIG. 8 with the inserts removed.

The base member 54 also includes an upper trailing side surface 64 (referred to hereafter as "trailing side surface"), and a pair of lateral side surfaces 66, 68. The trailing side surface 64 and the contact surface 60 meet to define an alignment edge 66. The trailing side surface 64, the lateral side surfaces 66, 68, and the contact surface meet to define leading edge or alignment edge corners 70, 72. The trailing side surface 64 of the base member 54 is a substantially flat surface arranged generally perpendicular to the leading side surface 60. For example, as best seen in FIG. 12, the leading side surface defines a plane P (the broad dimension of the plane P extends into the paper in FIG. 12) and the trailing side surface defines a plane Q (the broad dimension of the plane Q also extends into the paper in FIG. 12) such that the plane P is located substantially perpendicular to the plane Q.

As mentioned, repeated contact between the contact surface 60 of the work contact element and the broad side of the shingles during fastening operations may cause wear to the contact surface 60 and contact between the trailing side surface 64 of the work contact element and the ends or narrow edges of shingles during shingle alignment using the shingle gauge may cause wear to the trailing side surface 64 of the work contact element. In order to prevent or limit wear to the contact surface and trailing side surface of the work contact element during use of the fastener driving tool, the base member is provided two protection inserts 74, 76.

The protection inserts 74, 76 have substantially identical cubical configurations. In one embodiment, the inserts are cubes having sides of approximately 5 mm although other sized inserts may be used. The inserts are formed of a wear resistant material. In one embodiment, the protection inserts 74, 76 are formed of a carbide material, such as tungsten carbide, although any suitable wear resistant material may be used. The two protection inserts 74, 76 are sized and positioned in the base member 54 to maximize the protection capability of the two inserts while minimizing cost and complexity of manufacturing and the impact on the structural integrity of the support member.

Figure 10:
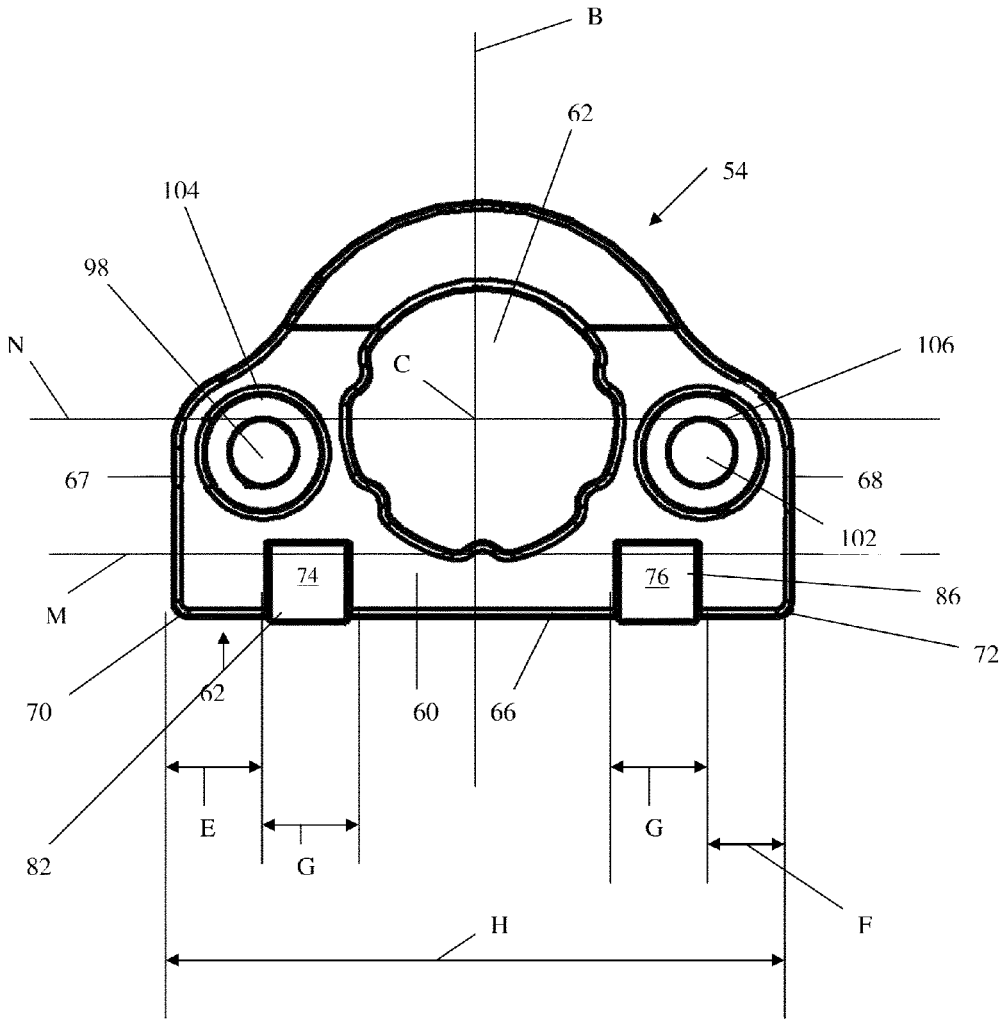
FIG. 10 is a bottom view of the work contact element of FIG. 8.
Figure 11:
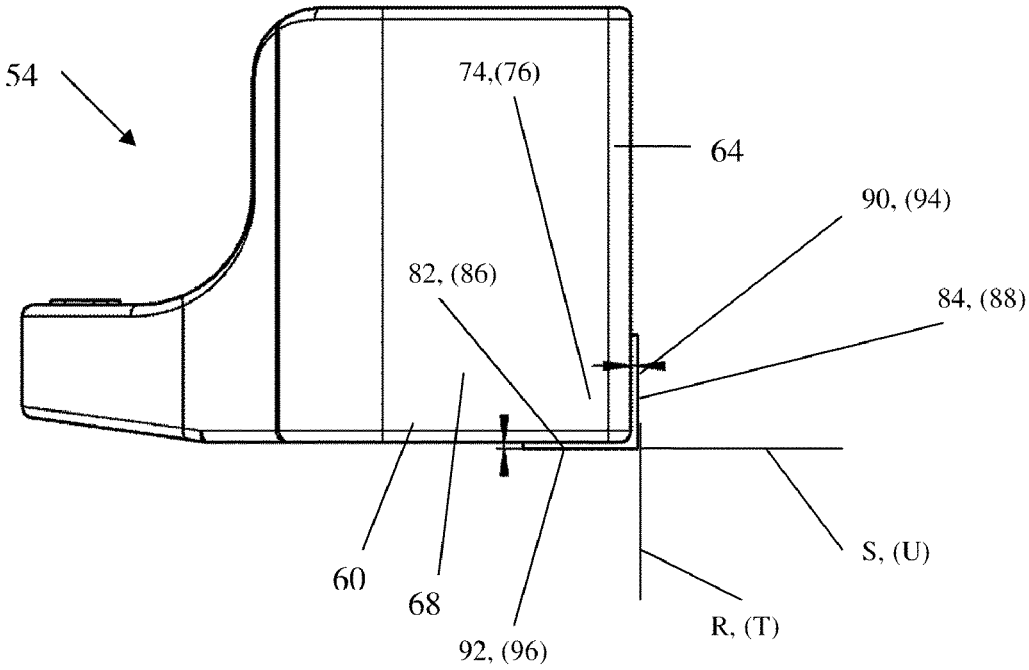
FIG. 11 depicts a side view of the work contact element of FIG. 8.

The protection inserts 74, 76 are positioned in a pair of recesses formed in the base member that are spaced apart along the alignment edge. In one embodiment, the inserts 74, 76 are affixed to the recesses using a brazing process although the inserts may be affixed to the recesses in any suitable manner. FIG. 12 shows a cross-sectional view of one of the recesses 78 in the base member 54 of the work contact element. As depicted in FIG. 12, the leading side surface 60 includes an opening 82 that is aligned with the recess 78 and the trailing side surface 64 includes an opening 84 that is aligned with the recess 78. Although not depicted in FIG. 12, the leading side surface 60 and the trailing side surface 64 include similar openings 86, 88 in the leading side surface and the trailing side surface, respectively, that are aligned with the recess 80 for the other protection insert. Referring to FIG. 10, the opening 82 in the leading side surface 60 for insert 74, the opening 86 in the leading side surface 60 for the insert 76, and the ejection orifice 62 are positioned with respect to each other and sized so that a line M extending on the leading side surface 60 of the base member intersects each of the ejection orifice 62, the opening 82, and the opening 86.

An insert is positioned in a recess so that it extends through both openings associated with the recess. For example, referring to FIG. 11, insert 74 is positioned in recess 78 such that surface 90 of insert 74 extends through the opening 84 in the trailing side surface 64 and surface 92 of the insert 74 extends through the opening 82 in the leading side surface 60. In one embodiment, the surface 90 of insert 74 defines a plane R that is substantially parallel to the plane Q of the trailing side surface 64 (FIG. 12) and perpendicular to the plane P (FIG. 12) of the contact surface 60, and the surface 92 of insert 74 defines a plane S that is substantially parallel to the plane P (FIG. 12) of the contact surface 60 and perpendicular to the plane Q of the trailing side surface (FIG. 12). Similarly, although not depicted in FIG. 11, insert 76 is positioned in recess 80 such that surface 94 of insert 76 extends through the opening 88 in the trailing side surface 64 and surface 96 of the insert 76 extends through the opening 86 in the leading side surface 60 with surface 94 of insert 76 defining a plane T that is substantially parallel to the plane Q of the trailing side surface 64 and perpendicular to the plane P of the contact surface 60, and with surface 96 of insert 76 defining a plane U that is substantially parallel to the plane P of the contact surface 60 and perpendicular to the plane Q of the trailing side surface 64. The inserts 74, 76 are sized to protrude a minimum distance from the base member while still being able to take the brunt of the contact with the abrasive surface of shingles. In one embodiment, the inserts 74, 76 are sized to protrude from the openings a distance of approximately 1 mm on both the contact surface 60 and trailing side surface 64 although the inserts may protrude from the trailing side surface and contact surface any suitable distance.

To enhance the ability of the work contact element to align shingles, the planes R and plane S of insert 74 meet to form a substantially 90 degree angle (i.e., right angle), and the plane T and plane U of insert 76 meet to form a substantially 90 degree angle. The right angles of the exposed edge or corners of the inserts enable the inserts to be used to push against the narrow edge during the shingle alignment process described above in relation to the shingle gauge while minimizing the chance that the inserts and consequently the work contact element of the fastener driving tool slipping over the edge of the shingles as might happen if the inserts had rounded or chamfered corners or edges.

The two protection inserts 74,76 are positioned along the alignment edge 66 of the base member 54 to minimize their impact on the structural integrity of the base member while still providing protection to both the contact surface 60 and the trailing side surface 64 and a stable aligning surface for use when aligning shingles using the shingle gauge. For example, positioning one or more inserts in the alignment edge 66 in front of the ejection orifice 65 may weaken the base member material that is positioned between alignment edge 66 and the ejection orifice 62 making the base member susceptible to cracking or breaking along the edge 66 during use. Accordingly, each protection insert 74, 76 is positioned so as to be on opposing sides of the ejection orifice 62. In particular, referring to FIG. 10, each protection insert 74, 76 is positioned on opposite sides of a center line B that is perpendicular to the alignment edge 66 and that passes through a center point C defined by the ejection orifice 62, or fastener passage 24. In one embodiment, the protection inserts 74, 76 are equidistant from the center line. In addition, the inserts 74, 76 are each spaced from the center line B a distance that enables the inserts to be spaced laterally from at least the widest portion of the ejection orifice 62 thus allowing the base member material between the ejection orifice 62 and the alignment edge 66 to retain its strength.

As depicted in FIG. 10, the inserts are also each laterally spaced from the nearest lateral surface 67, 68 or leading edge corner 70, 72 of the base member. In particular, insert 74 is spaced apart from the lateral surface 67 by a distance E, and insert 76 is spaced apart from the lateral surface 68 by a distance F. In one embodiment, the distances E and F are substantially equal. The inserts are thus each positioned "within" the confines of the alignment edge so that each insert is in contact with the base member along the four internal sides of the respective recess 78, 80 in the base member thereby increasing the effectiveness of the brazing process.

The size of the inserts 74, 76 is selected to minimize the weight added to the base member while still allowing the inserts to provide adequate protection to the contact surface 60 and trailing side surface 64 and a stable alignment surface. In one embodiment, the inserts 74, 76 are sized so that their combined extent along the alignment edge 66 is less than half of the entire length of the alignment edge 66 between the lateral side surfaces 66, 68. In one particular embodiment, the inserts 74, 76 are sized so that their combined extent along the alignment edge is less than one third of the entire length of the alignment edge between the lateral side surfaces. For example, as depicted in FIG. 10, the lateral surface and the lateral surface are separated by a distance H. The insert extends along the alignment edge a distance G and the insert extends along the alignment edge the same distance G where $(G+G)/H<1/2$, and, in some embodiments, $(G+G)/H<1/3$.

Figure 13:
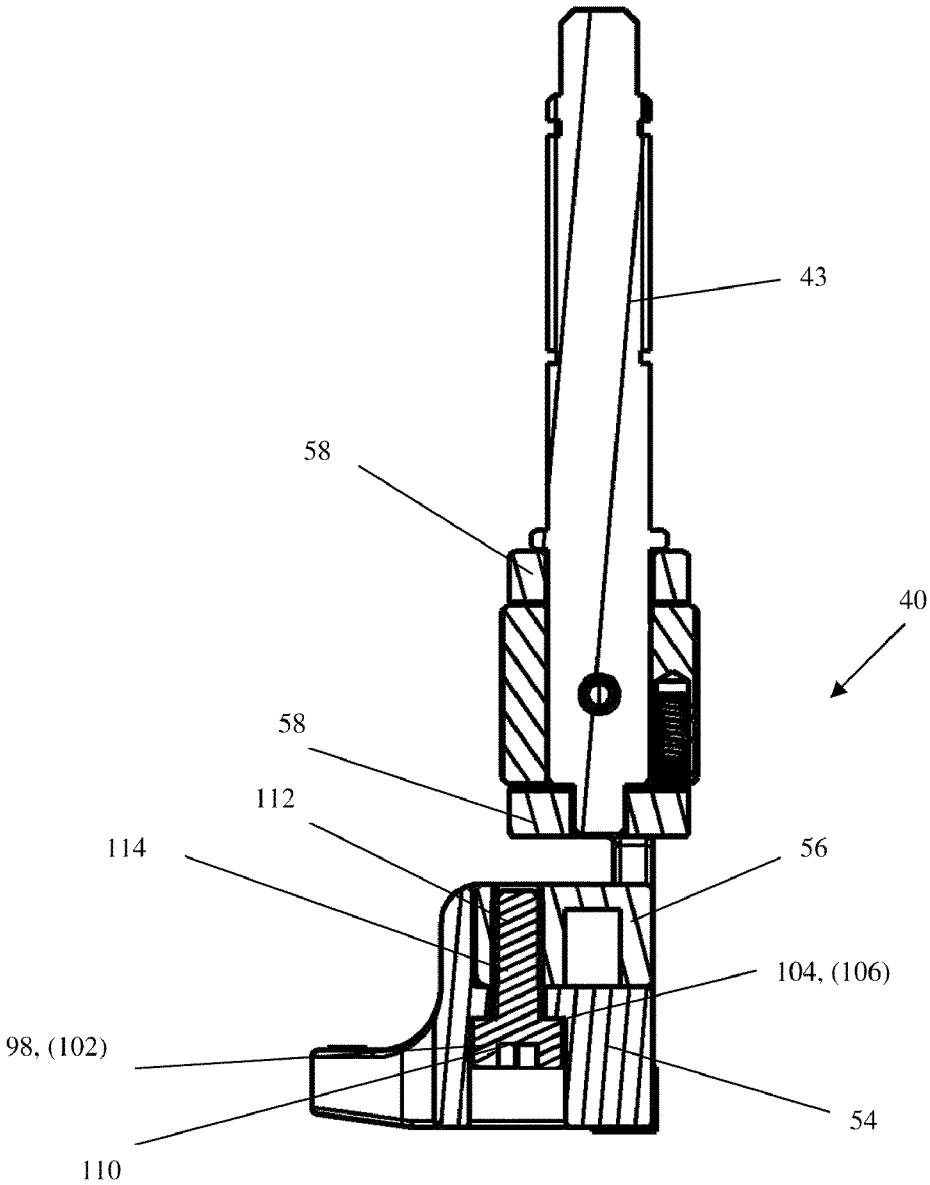
FIG. 13 depicts a side cross-sectional view of the work contact element and depth adjustment assembly of the safety contact assembly of FIG. 6.

An advantage of positioning the inserts 74, 76 at the alignment edge 66 of the base member 54 and not in the central portion of the leading surface 60 as in some previously known systems is that much of the area of the leading surface 60 is left available for the incorporation of attachment features for removably attaching the base member 54 to the support member 56. In one embodiment, with reference to FIGS. 9, 10, and 13, the base member 54 is provided with fastener holes 98, 102 that extend through the base member 54 toward the support member 56 on opposing sides of the center line C of the ejection orifice. Recessed surfaces 104, 106 are provided that at least partially surround the fastener holes 98, 102, respectively. Conventional fasteners 108 may be used to secure the base member 54 to the support member 56. A fastener 108 is inserted into each of the holes. The fasteners 108 each include a head portion 110 that contacts the corresponding recessed surface 104, 106 when inserted and a fastener portion 112 that extends through the fastener hole toward the support member. The support member 56 is provided with fastener receiving structures 114 that are configured for removable connection to the fastener portions 112 of the fasteners. The ejection orifice 62, recessed surface 104, and recessed surface 106 are sized and positioned with respect to each other so that a plane N bisecting the leading side surface 60 of the base member intersects each of the ejection orifice 62, recessed surface 104, and recessed surface 106. Such a configuration for the attachment of the base member to the support member allows easy access to the fasteners for the removal of the base member for maintenance or replacement as necessary.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A fastener driving tool comprising:

a housing;

a nose assembly having a fastener passage configured to allow fasteners to be advanced therethrough, said nose assembly being movable in relation to said housing between a disable position and an enable position;

a magazine assembly configured to supply fasteners toward said nose assembly; and a driver configured to cause a fastener located in said fastener passage to be advanced within said nose assembly, wherein said nose assembly includes (i) a base member defining at least a portion of said fastener passage and having a first recess and a second recess which are spaced apart from each other, (ii) a first protection insert located in said first recess, and (iii) a second protection insert located in said second recess, wherein said base member defines a leading side surface and a trailing side surface, wherein said leading side surface defines an ejection orifice that is aligned with said fastener passage, wherein said leading side surface defines a first opening aligned with said first recess and a second opening aligned with said second recess, wherein said trailing side surface defines a third opening aligned with said first recess and a fourth opening aligned with said second recess, wherein said first protection insert extends through said first opening and said third opening, and wherein said second protection insert extends through said second opening and said fourth opening.

2. The fastener driving tool of claim 1 wherein said ejection orifice, said first opening, and said second opening are positioned with respect to each other so that a line extending on said leading side surface of said base member intersects each of said ejection orifice, said first opening, and said second opening.

3. The fastener driving tool of claim 1 wherein:

said leading side surface defines a first plane, said trailing side surface defines a second plane, and said first plane is located substantially perpendicular to said second plane.

4. The fastener driving tool of claim 1, said leading side surface defines a first plane, said trailing side surface defines a second plane, and said first protection insert defines a third plane and a fourth plane, said second protection insert defines a fifth plane and a sixth plane, said first plane of said leading side surface is substantially parallel to both (i) said third plane of said first protection member, and (ii) said fifth plane of said second protection member, and said second plane of said trailing side surface is substantially parallel to both (i) said fourth plane of said first protection member, and (ii) said sixth plane of said second protection member.

5. The fastener driving tool of claim 4, wherein:

said third plane and said fourth plane meet to form a substantially right angle, and said fifth plane and said sixth plane meet to form a substantially right angle.

6. The fastener driving tool of claim 1 wherein each said first protection insert and said second protection insert is made of a carbide material.

7. The fastener driving tool of claim 1, wherein:

said base member is made of a first material, each of said first protection insert and said second protection insert is made of a second material, and said first material is different than said second material.

8. The fastener driving tool of claim 7, wherein:

said first material is a carbide material, and said second material is a steel material.

9. The fastener driving tool of claim 1, wherein each of each of said first protection insert and said second protection insert possesses a cubical configuration.

10. The fastener driving tool of claim 1, wherein:

said trailing side surface defines a first lateral edge and a second lateral edge, said first protection insert is spaced apart from said first lateral edge by a first distance D1, said second protection insert is spaced apart from said second lateral edge by a second distance D2, and said first distance D1 is substantially equal to said second distance D2.

11. The fastener driving tool of claim 1, wherein each of said first protection insert and said second protection insert is attached to said base member by a brazing process.

12. The fastener driving tool of claim 1, wherein:

said trailing surface of said base member defines a first leading corner, a second leading edge, and a leading edge line segment extending therebetween, said first leading corner is separated from said second leading corner by a first distance D1, said first recess extends for a second distance D2 along said leading edge line segment, said second recess extends for a third distance D3 along said leading edge segment, $$(D2+D3)/D1<½.$$

13. The fastener driving tool of claim 12, wherein (D2+D3)/D1<1;3.

14. The fastener driving tool of claim 1, wherein:

said trailing side surface of said base member defines a first leading corner, a second leading edge, and a leading edge line segment extending therebetween, said ejection orifice defines a center point through which a center line passes, said center line being perpendicular to said leading edge line segment, said first protection insert and said second protection insert each being spaced from said center line and on opposite sides of said center line.

15. The fastener driving tool of claim 14, wherein:

said first protection insert is spaced apart from said center line by a first distance D1, said second protection insert is spaced apart from said center line by a second distance D2, and said first distance D1 is substantially equal to said second distance D2.

16. The fastener driving tool of claim 1, further comprising:

a support member to which said base member is removably attached.

17. The fastener driving tool of claim 16, wherein:

said leading side surface defines a first fastener hole and a first recessed surface that at least partially surrounds the first fastener hole, the first fastener hole being spaced from said first recess, said second recess, and said ejection orifice and extending through said base member from said leading side surface toward said support member, said fastener driving tool further comprises a first fastener having (i) a head portion contacting the first recessed surface, and (ii) a fastener portion extending through said first fastener hole, and said support member includes a first fastener receiving structure aligned with said first fastener hole, said first fastener structure being configured to receive the fastener portion therein.

18. The fastener driving tool of claim 17, wherein:

said leading side surface defines a second fastener hole and a second recessed surface that at least partially surrounds the second fastener hole, the second fastener hole being spaced from said first recess, said second recess, said ejection orifice, and said first fastener hole and extending through said base member from said leading side surface toward said support member, said fastener driving tool further comprises a second fastener having (i) a head portion contacting the second recessed surface, and (ii) a fastener portion extending through said second fastener hole, and said support member includes a second fastener receiving structure aligned with said second fastener hole, said second fastener structure being configured to receive the fastener portion of the second fastener therein.

19. The fastener driving tool of claim 18, wherein said first fastener hole and said second fastener hole are positioned on opposing sides of said ejection orifice.

20. The fastener driving tool of claim 19 wherein said ejection orifice, said first recessed surface, and said second recessed surface are positioned with respect to each other so that a plane bisecting said leading side surface of said base member intersects each of said ejection orifice, said first recessed surface, and said second recessed surface.

* * * * *

UNITED STATES PATENT AND TRADEMARK OFFICE

CERTIFICATE OF CORRECTION

PATENT NO. : 7,870,987 B1
APPLICATION NO. : 12/494633
DATED : January 18, 2011
INVENTOR(S) : Zhang et al.

It is certified that error appears in the above-identified patent and that said Letters Patent is hereby corrected as shown below:

Claim 13, lines 13-14: Replace "(D2+D3)/D1<1;3" with --(D2+D3)/D1<1/3--

Signed and Sealed this
Twenty-second Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,870,987 B1
APPLICATION NO. : 12/494633
DATED : January 18, 2011
INVENTOR(S) : Zhang et al.

It is certified that error appears in the above-identified patent and that said Letters Patent is hereby corrected as shown below:

Claim 13, column 10, lines 13-14: Replace "(D2+D3)/D1<1;3" with --(D2+D3)/D1<1/3--

This certificate supersedes the Certificate of Correction issued March 22, 2011.

Signed and Sealed this
Twenty-sixth Day of April, 2011

David J. Kappos

David J. Kappos
*Director of the United States Patent and Trademark Office*